United States Patent [19]

Fusco

[11] 4,144,022

[45] Mar. 13, 1979

[54] FURNACE ROLLERS

[75] Inventor: Ronald S. Fusco, Mentor, Ohio

[73] Assignee: Amax Inc., Greenwich, Conn.

[21] Appl. No.: 786,076

[22] Filed: Apr. 11, 1977

[51] Int. Cl.[2] ..... F27D 3/00

[52] U.S. Cl. ..... 432/246; 432/249; 75/176; 29/132; 266/257; 193/37

[58] Field of Search ..... 432/233–236, 432/239, 243, 246, 249, 60, 228; 193/37; 266/252, 254, 257; 29/132, 115; 75/176

[56] References Cited

U.S. PATENT DOCUMENTS

| | | | |
|---|---|---|---|
| 1,539,833 | 6/1925 | Fahrenwald | 432/246 |
| 2,048,239 | 7/1936 | Wirth | 75/176 |
| 2,147,329 | 2/1939 | Willey | 75/176 |
| 2,643,964 | 4/1953 | Cooper | 29/132 |
| 2,960,403 | 11/1960 | Timmons | 75/176 |
| 3,037,756 | 6/1962 | Ornitz | 432/246 |
| 3,169,860 | 2/1965 | Semchyshen | 75/176 |
| 3,489,397 | 1/1970 | Alexander | 29/115 |
| 3,720,990 | 3/1973 | Larsen | 75/176 |
| 3,968,551 | 7/1976 | Miyashita | 29/132 |
| 3,988,118 | 10/1976 | Grerson et al. | 75/176 |
| 3,997,370 | 12/1976 | Horvath, Jr. et al. | 29/132 |

FOREIGN PATENT DOCUMENTS

| | | | |
|---|---|---|---|
| 741361 | 11/1955 | United Kingdom | 75/176 |
| 495381 | 3/1975 | U.S.S.R. | 75/176 |
| 424899 | 4/1975 | U.S.S.R. | 75/176 |

*Primary Examiner*—Henry C Yuen

*Attorney, Agent, or Firm*—Michael A. Ciomek

[57] ABSTRACT

Conveying rollers for roller-hearth furnaces and the shafts upon which the rollers are mounted are made of molybdenum. The rollers can be either cylindrical or of the disc type. Molybdenum conveying rollers and shafts can be used at temperatures above 1200° C. in reducing atmospheres without distorting or cracking.

3 Claims, 2 Drawing Figures

FURNACE ROLLERS

FIELD OF THE INVENTION

The present invention relates to roller-hearth furnaces and more particularly to rollers for roller-hearth furnaces.

BACKGROUND OF THE INVENTION

Roller-hearth furnaces are well known in the art and are useful for the uniform treatment of high production items. This type of furnace is generally used for annealing, normalizing and sintering operations. Roller-hearth furnaces can be constructed as a single furnace or as a series of furnaces for zone heating and cooling.

Roller-hearth furnaces are equipped with cylindrical or disc type rollers. Disc type rollers are employed for continuously treating short lengths of sheet material to reduce the cooling effect of full contact with cylindrical type rollers and to minimize scratching by reducing the amount of contact area. When disc type rollers are employed, they are mounted on shafts in such a manner that discs on adjacent shafts are staggered. Whether disc or cylindrical rollers are employed, the shafts upon which the discs or cylindrical rolls are mounted are driven by variable speed motors either through a chain and sprocket system or through shafts and gears.

Furnaces used for heat treating operations in excess of about 1000° C. are usually equipped with conveying rollers made of heat resisting nickel base alloys. Conveying rollers made of heat resisting nickel base alloys suffer from distortion and short life at the high operating temperatures particularly where frequent thermal cycling is involved, especially at furnace entrances or exits where the rollers are exposed to sharp thermal gradients. A conveying roller made of a heat resisting nickel base alloy used in a furnace operated at about 1200° C. in a reducing atmosphere typically fails from cracking and distortion in about two to six months.

The life of conveying rollers made of heat resisting nickel base alloys can be further shortened when the rollers are used in non-oxidizing or reducing atmospheres. Many heat resisting nickel base alloys are designed to operate at high temperatures under oxidizing conditions. When these nickel base alloys are used at high temperatures under reducing conditions, protective oxide coatings can be destroyed, and carbides, nitrides and hydrides can be formed which can accelerate cracking and distortion, drastically lowering the life of the rollers made of these alloys.

Not only are conveying rollers made of heat resisting metal base alloys expensive but the downtime for maintenance and replacement interferes with process control and lowers overall production.

BRIEF SUMMARY OF THE INVENTION

Generally speaking, the present invention relates to conveying rollers for roller-hearth furnaces. The roller comprises a molybdenum shaft and a molybdenum conveying roller mounted on the shaft, the conveying roller being cylindrical or a series of separated discs.

The conveying rollers of the present invention are advantageously employed in a roller-hearth furnace for heat treating metals at elevated temperatures under reducing conditions, which furnace comprises a heating chamber, rotatable molybdenum shafts extending across the chamber, means for rotating the shafts and molybdenum conveying rollers mounted on each shaft.

DETAILED DESCRIPTION

Figure 1:
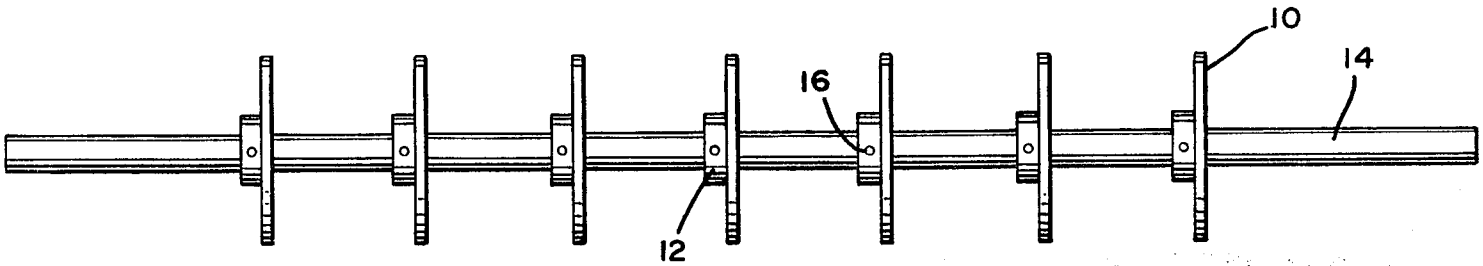
FIG. 1 depicts disc-type conveying rollers in accordance with the present invention.

Referring now in detail to the drawings, the disc-type conveying roller illustrated in FIG. 1 consists of machined molybdenum discs 10 having integral collars 12 pinned to molybdenum shaft 14. Discs 10 are pinned to shaft 14 by pins 16 which are also made of molybdenum. An experimental disc-type conveying roller as shown in FIG. 1 was tested in a roller-hearth furnace operated at a temperature up to 1200° C. in a hydrogen atmosphere for over 8 months without any evidence of distortion or cracking.

Figure 2:
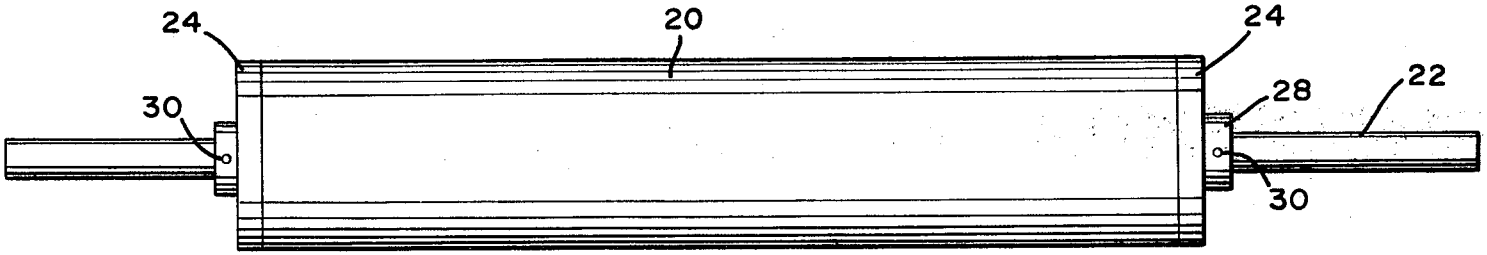
FIG. 2 depicts a cylindrical type conveying roller in accordance with the present invention.

The cylindrical type roller shown in FIG. 2 is also made entirely of molybdenum. In this embodiment, an extruded molybdenum tube 20 is mounted on molybdenum shaft 22 with machined molybdenum end plates 24. The machined molybdenum end plates 24 are similar in design to the molybdenum discs described in FIG. 1 and have integral collars 28. The end plates are pinned to shaft 22 by molybdenum pins 30. Although solid molybdenum rollers can be employed, the added weight and expense outweigh the advantages flowing from the more rugged solid structure. An experimental cylindrical type roller depicted in FIG. 2 was tested in a roller-hearth furnace operated at temperatures up to about 1200° C. in a hydrogen atmosphere. After 18 months the rolls showed no evidence of distortion or cracking.

The long service life of molybdenum rollers having the designs depicted in FIGS. 1 and 2 without any evidence of distortion or cracking at elevated temperatures up to 1200° C. in hydrogen atmospheres compare with service lives of only 2 to 6 months for similar rollers made of heat resisting nickel base alloys.

The furnace rollers in accordance with the present invention have been described as being made of metallic molybdenum. Those skilled in the art will recognize the molybdenum base alloys, such as binary alloys of molybdenum and titanium and molybdenum and tungsten, which possess substantially the same properties of high strength at elevated temperatures, high melting points, high modulus of elasticity, low thermal expansivity, low specific heat and high thermal conductivity, that provide excellent thermal shock resistance, heat transfer and fatigue properties as does metallic molybdenum can also be employed, because these properties are the reasons that metallic molybdenum functions so well as furnace rollers.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and the appended claims.

I claim:

1. In a roller-hearth furnace for treating metals in reducing atmospheres, which furnace includes a heating chamber, rotatable shafts extending across the heating chamber, rollers mounted on the shaft, and means for rotating the shafts, the improvement which comprises rotatable metallic molybdenum shafts and metallic molybdenum rollers.

2. The improvement described in claim 1 wherein the roller is a cylindrical molybdenum tube.

3. The improvement described in claim 1 wherein the roller comprises a series of separated discs mounted on the shaft.

* * * * *